United States Patent [19]

Thompson

[11] 4,110,881

[45] Sep. 5, 1978

[54] RESILIENT ARTICLE AND METHOD OF MANUFACTURE

[76] Inventor: M. Stafford Thompson, P.O. Box 113, Enfield, Conn. 06082

[21] Appl. No.: 749,380

[22] Filed: Dec. 10, 1976

[51] Int. Cl.[2] ..... A47C 27/12

[52] U.S. Cl. ..... 29/91.1; 53/524; 83/7; 267/145; 297/DIG. 1

[58] Field of Search ..... 83/5–12; 29/91, 91.1; 267/145; 297/DIG. 1; 53/125

[56] References Cited

U.S. PATENT DOCUMENTS

| | | | |
|---|---|---|---|
| 1,248,540 | 12/1917 | Peterson | 83/11 |
| 2,638,156 | 5/1953 | Berman | 267/145 |
| 2,785,739 | 3/1957 | McGregor et al. | 29/91 X |
| 2,803,302 | 8/1957 | Kuts | 83/7 |
| 3,273,180 | 9/1966 | Feinerman | 297/DIG. 1 |
| 3,515,019 | 6/1970 | Tyer, Jr. | 83/5 |
| 3,594,045 | 7/1971 | Pannier et al. | 83/11 X |
| 3,909,342 | 9/1975 | Shook | 83/11 X |
| 3,927,587 | 12/1975 | Jackson | 83/8 |
| 3,964,353 | 6/1976 | Fowler | 83/11 X |

FOREIGN PATENT DOCUMENTS

| | | | |
|---|---|---|---|
| 2,051,180 | 2/1971 | France | 83/5 |

*Primary Examiner*—J. M. Meister

[57] ABSTRACT

Resilient articles, such as, mattresses and cushions of varying yield resistance to accommodate the weight variation of the body and/or to provide edge support are produced by tailoring tensile forces within the article. Tensile force variation may be accomplished in articles of uniform density by slotting to separate adjacent regions in at least one direction. Tailoring is accomplished by variation in slot depth and/or spacing.

4 Claims, 9 Drawing Figures

RESILIENT ARTICLE AND METHOD OF MANUFACTURE

BACKGROUND OF THE INVENTION

1. Field of the Invention

The invention is concerned with articles manifesting a variation in compressability for adapting to unequal loading. Articles of particular significance are mattresses, cushions, etc., for supporting or partially supporting the human body. Articles of interest are produced from continuous sections of a yieldable material, such as, foamed plastic or rubber.

2. Description of the Prior Art

The preemptive position once enjoyed by conventional fibrous particulate materials, sometimes incorporating separate spring elements, has long since yielded to modern technology. For many purposes, manufacture is dominated by moldings of continuous material, such as, natural rubber or synthetic polymers. It is common to increase compressability in such molded objects by foaming; and exemplary articles now marketed make use, for example, of foamed polyurethane.

By the time this new technological approach had been introduced, the earlier manufacturing techniques had reached a level of sophistication in which provision had already been made for unequal loading. So, for example, mattresses of the "inner spring" variety had been popularly marketed. Such structures permit regions of greater loading to yield to a lesser extent than and in a manner more or less independent of adjacent regions of lesser loading. Designers of molded counterparts early recognized the desirability of tailoring yield, and many approaches have been used. A prevalent approach depends on incorporation of foaming agents which produce gas bubbles and, therefore, local expansion. Another approach involves a variation in distribution of such foaming agents or, alternatively, a variation in activation of such agents, to result in unequal expansion—therefore, in tailored density resulting in the desired variation in compressibility. Another alternative which may be considered as involving a density variation on a massive scale makes use of spiked molds which result in surface craters, generally of even spacing but sometimes of varying spacing, so as both to increase and sometimes tailor compressibility. Particularly where large voids are introduced, this approach is necessarily practiced on a non-supporting surface.

Increased compressibility may be accomplished by producing voids by other means; and known articles have been produced by use of continuous slots, sometimes intersecting. While slotting has commonly been discussed as an alternative approach to reducing effective density, it has sometimes been considered analogous to the use of independently acting, separately inserted springs. Analogous to such prior art construction, slotting has been of uniform depth and spacing so as to produce uniform, individual yield characteristics.

SUMMARY OF THE INVENTION

Bodies of molded material are provided with slots varying in spacing and/or depth so as to (1) increase compressibility and (2) tailor compressibility so as to accommodate unequal loading. Such articles, which may serve, for example, as cushions or mattresses, may be fabricated utilizing natural or manmade resilient polymeric material either of the thermoplastic or thermosetting variety. Slotting may be accomplished during and as an inherent part of a molding operation which, in the usual embodiment, entails expansion as by use of a foaming agent.

Heated or unheated slotting tools may take the simple form of knives, wires, etc., and be moved to define desired patterns—e.g., line arrays, grids, or helices; or, alternatively, may be shaped to produce the desired pattern in one or a small number of motions. Unheated tools, perhaps of simple form may rely on a shearing or cutting action. An economically attractive embodiment involves preparation of a massive "loaf" which is sliced into final dimensions and, finally, slotted.

Every embodiment in accordance with the invention incorporates a variation in compressibility based either on a variation in slot depth and/or spacing. Slot patterns may be continuous or discontinuous; intersecting or not; straight line or curved. Simple patterns may be formed of slots of both uniform spacing and depth over some region with a variation in some other region, as, for example, in a simple pad with an unslit border region at least along one edge.

Preferred embodiments are, generally, somewhat more complex and depend on patterns of slot-defined isolated regions of varying depth and/or area which may respond to unequal loading individually with virtual elimination of constraining tensile forces. While the simpler embodiments are likely to be straight-lined, they may assume any other configuration toward a given objective. All embodiments require that the independently compressible portions of the structure be attached to one another, preferably with a "web" of material—that is, an unslit region generally extending over the entirety of the two greater dimensions of the article. While the web may include a free surface, it may take the form of an intermediate region. An intermediate layered web of this nature may be utilized in a reversible article with appropriate slots on either side to result in a "soft side" and a "firm side". Other variations are evident.

It is an advantage of the inventive approach that a rubber or plastic article may be complete unto itself with all physical properties depending upon the nature of the slotting. Alternative structures may utilize coverings, for example, conventional mattress ticking, and/or other cushioning materials, such as, fibrous mats or foam sheets. In still other embodiments, use may be made of varying density as utilized in prior art techniques in combination, however, with the variable slotting of the invention.

DETAILED DESCRIPTION

1. The Drawing

Figure 1:
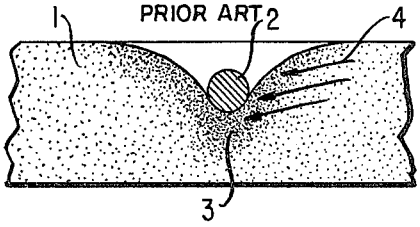
FIG. 1 PRIOR ART
FIG. 1 is a schematic cross-sectional view depicting the yield mechanism for an unslotted prior art article.

FIG. 1 is a cross-sectional view of a portion of a foam slab 1 to which a load 2 is applied. It is evident that yield is influenced by compression, particularly in region 3, but, in addition, by a combination of forces including tension, for example, in region 4.

Figure 2:
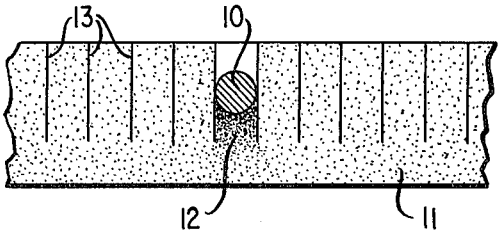
FIG. 2 is such a schematic cross-sectional view of a portion of a slotted article in accordance with the invention, again depicting the nature of the yield mechanism.

In FIG. 2, incorporating a section of a slotted structure in accordance with the invention, the same type of load, here depicted 10, as applied to structure 11, results in a virtual separation of tension and compression so that yield is dictated primarily by compression (region 12 with tension being minimized by the presence of slots 13). This is particularly true if the structure is slotted parallel to the plane of the page and is incorporated so that load 10 is supported by an island of material defined by intersecting slots.

Figure 3:
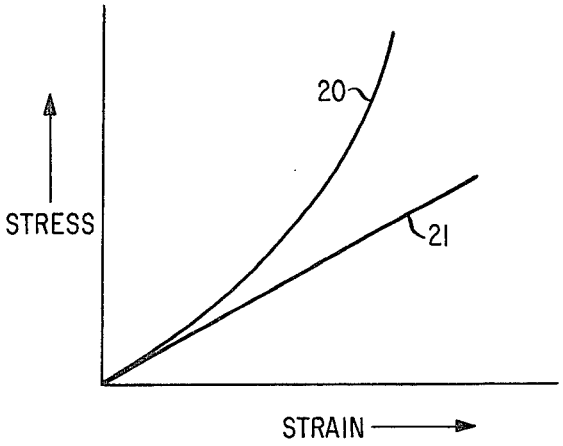
FIG. 3, on coordinates of stress on the ordinate and strain on the abscissa, includes two curves, one showing the nature of the relationship between these two parameters for a structure of the nature of that of FIG. 1 and the other for a structure in accordance with the invention (as exemplified by FIG. 2)

FIG. 3 shows the form of the stress-strain relationship for the two cases—i.e., FIG. 1 and FIG. 2. It is seen from curve 20 (for the prior art structure exemplified by FIG. 1) that total yield resistance increases non-linearly for increasing stress. The linear relationship of curve 21 for an ideal case in accordance with the invention (load resisted by an isolated region of dimensions approximating that of the load) is indicative of increased compressibility but is more significant in suggesting a tailored structure precisely responsive to the nature of the load.

Figure 4:
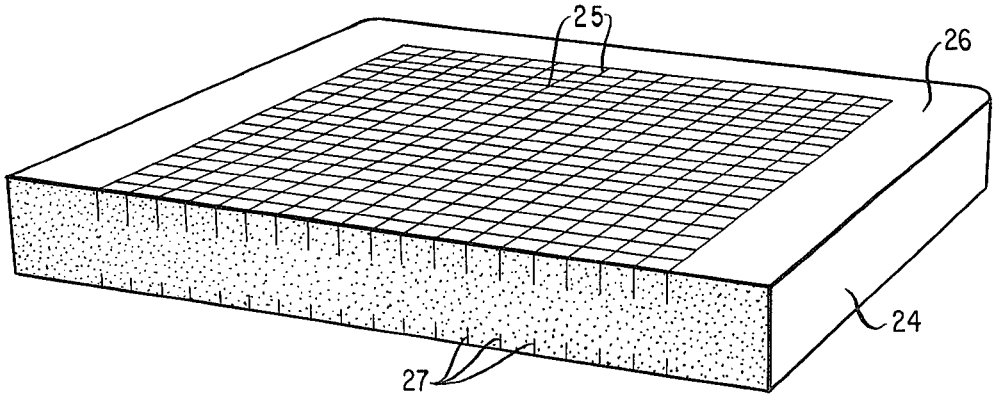
FIG. 4 is a perspective view of a section of an article in accordance with the invention which may serve, for example, as a mattress.

FIGS. 4 through 8 depict a variety of species in accordance with the invention. In FIG. 4, article 24, designed to serve, for example, as a mattress, is, except for a border region 26, slotted so as to form gratings 25 and 27 both formed of equally spaced slots of constant depth but differing in depth from one grating to the other so as to form a firm-soft reversible body.

Figure 5:
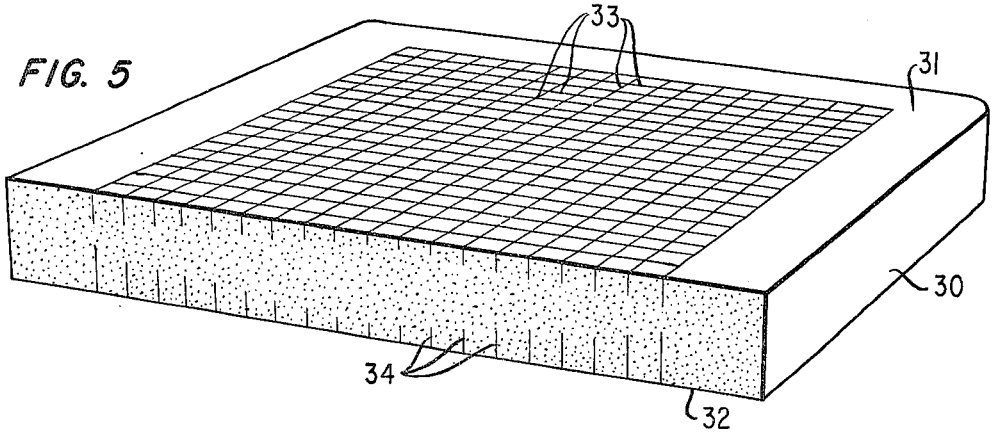
FIG. 5 is a perspective view of a section of an article in accordance with the invention included to show a slotting arrangement alternative to that of FIG. 4.

In FIG. 5, tailored firmness in directions away from border region 31 of article 30 results from decreasing slot depth in both of gratings 33 and 34. Depth may optionally vary in slots parallel to the section edge and/or within individual slots as well. As in others of the depicted embodiments, reversibility is a feature of the article with surface 31 somewhat firmer due to shallower slotting.

In FIG. 6, article 40, again surface-slotted by gratings, here depicted as 41 and 44 on surfaces 43 and 42, respectively, makes use of decreasing slot spacing in both gratings rather than a variation in depth to result in an increase in firmness away from border region 45 on surface 43 and toward border region 45 on surface 42. The particular article shown in this Figure is again convertible—as depicted, the upper surface utilizing shallow slotting is relativey firm. Variation in slot spacing on both surfaces results in a varying firmness of the same general nature. The article shown may serve as a convertible mattress.

Figure 7:
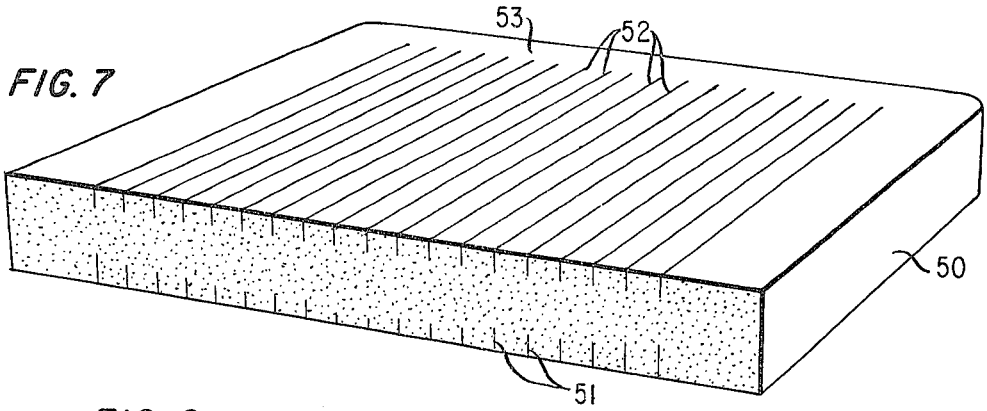
FIG. 7 is a perspective view of a section of an embodiment using a parallel slotting configuration in accordance with the invention.

FIG. 7 depicts a support structure 50 in which compressibility is tailored by parallel, non-intersecting slot arrays 51 and 52. Again relative firmness is provided in border region 53. The evenly spaced array 52 with its resultant constant yieldability is usefully employed as a cushion surface. The varying yieldability of array 51 may define a mattress surface.

Figure 8:
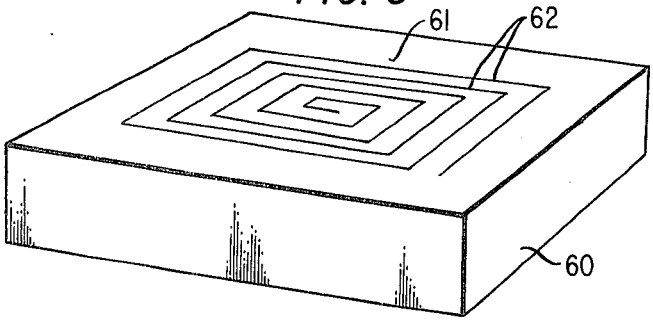
FIG. 8 is a perspective view of a cushion in accordance with the invention in which an alternative slotting pattern is used.

FIG. 8 is included to show one of many slot configuration variants. Cushion 60, again including a non-slotted border region 61, manifests increased yieldability in its central region due to a continuous slot of helical design 62.

Figure 9:
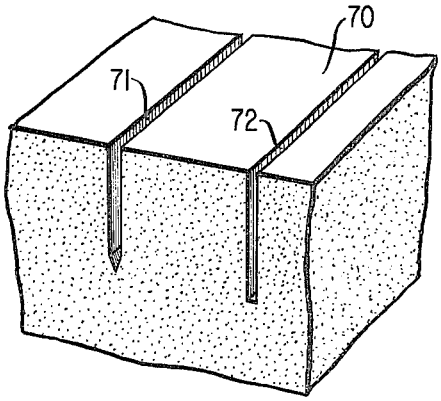
FIG. 9 is a perspective view in section of a body containing two different exemplary slot configurations.

FIG. 9 is a sectional view of a body 70 included to show two of many possible slot configurations. Either of slots 71 or 72 may be produced by heated or unheated slotting implements.

2. Design Parameters

A. Material

It is generally contemplated that structures of the invention utilize foamed polymeric material. In general, such foamed materials are of the closed bubble variety with expansion resulting from discrete bodies of decomposable matter which evolves gas during processing; from gas generated as a result of chemical reactions; or from gas dissolved under pressure and subsequently allowed to expand. Ordinarily, foaming agents are thermally decomposable, although other techniques have been utilized—e.g., X-ray, ultrasonic, etc. Alternatively, heat centers may result from selective absorption due to dispersed particulate matter. Workers in the art are familiar with a large variety of suitable material some thermoplastic (e.g., polyurethane), some thermosetting (e.g., isoprene). It is known to protect such materials from degradative influences, such as, oxidation, and to otherwise modify them by a variety of additives. Materials used in commercial production may, therefore, include additives serving as thermal antioxidants, UV light screens, colorants, or simply fillers (e.g., to reinforce or reduce cost).

In general, tailored yieldability is due entirely to slot conformation or spacing. In some instances, where larger variation is desired, slot conformation and/or spacing may be combined with firmness variation produced in manner known to prior art workers—e.g., by variation in density or size of expansion centers or by the removal of mass at and beneath the supporting surface, including areas adjacent to the slots.

It is an advantage of the invention that slotting may, itself, serve to produce a finished supporting surface. For decorative or sanitary reasons, however, slotted surfaces may be covered.

B. Slot Conformation

It has been indicated that slotting may be accomplished in a variety of manners. It may be produced as a final step subsequent to gross formation of the structure. It may result from moving knife edges, saw edges, heated scoring devices—either stationary or moving—or any combination thereof. On the other hand, slotting may be produced simultaneously with formation of the gross structure—e.g., by appropriately shaped mold surfaces.

Dimensional considerations are largely dictated by the specific nature of the structure. For optimum conditions, a load variation as great as two to one may be accommodated in a structure which contrasts unslotted areas with areas having an appropriate pattern of slots of sufficient depth. In a conventional mattress, slot spacing (of uniform or non-uniform slots) may typically range from perhaps 12 inches to perhaps 2 inches. The common objective of all embodiments in accordance with the invention—i.e., a lessening of the tensile contribution to yield resistance—suggests a slot depth of at least equal to the expected compression upon loading to achieve maximum compressibility. On this basis, maximum loading, assumed to correspond with unexpanded density, may dictate ultimate slot depth. Therefore, in a typical foamed material, in which the volume ratio of expanded/solid form may typically be 10:1, maximum slotting may be as great as ninety percent of the thickness.

An inventive requirement is concerned with the tailoring of the tensile force contribution and this necessarily contemplates variation in slot spacing and/or depth on a given support surface. Usual embodiments of such preferred structures contemplate slot depth and/or spacing variation of at least one-fourth inch and preferrably one-half inch in slotted regions. Such structures may additionally include unslotted border regions of minimal width of about one-half inch. Structures of uniform slot depth and spacing typically have borders at least two inches in width to provide desired edge support.

Depth variation may be produced within a single slot, as well as between separated slots. Spacing variation may result along the entirety of continuous slots of equal length or may result from discontinuous slots—slots which extend only over regions of greater desired yieldability.

Minimum slotting for regions of heaviest load may be zero as in the instance of a border. Slot depth as little as 1 percent of the overall thickness in the direction of loading results in a meaningful increase in yieldability and is considered a minimum useful depth. Usual considerations dictate a preferred minimum of five percent on the same basis.

Minimum interslot spacing, either in the constant or variable spacing embodiments, is dictated by the mechanical integrity of the structure. While a number of variants contribute to integrity, usual structures utilize a spacing-to-depth ratio no smaller than about 50 percent.

Characteristics of the inventive structures depend upon slot depth and spacing; and material removal is ordinarily not significant—may be absent entirely. Where slotting is produced by molding or due to collapse resulting from applied heating, some slight volume removal may result. Such removal is not considered a significant design parameter.

C. Processing

Most processing considerations are implicit in the above description. A particular variation, however, not permitted by the usual prior art process, may result in substantially reduced cost. It is the nature of many acceptable polymers that they are amenable to large body production. It is practical to form loaves of material such as polyurethane of dimensions limited only by equipment size. Such a loaf may be sliced to final structure configurations and, subsequently, slotted, as discussed. Should the material expand unequally, any variation of density within the loaf may be accomplished by a corresponding variation in slot depth and/or spacing.

D. Structural Variations

Figure 6:
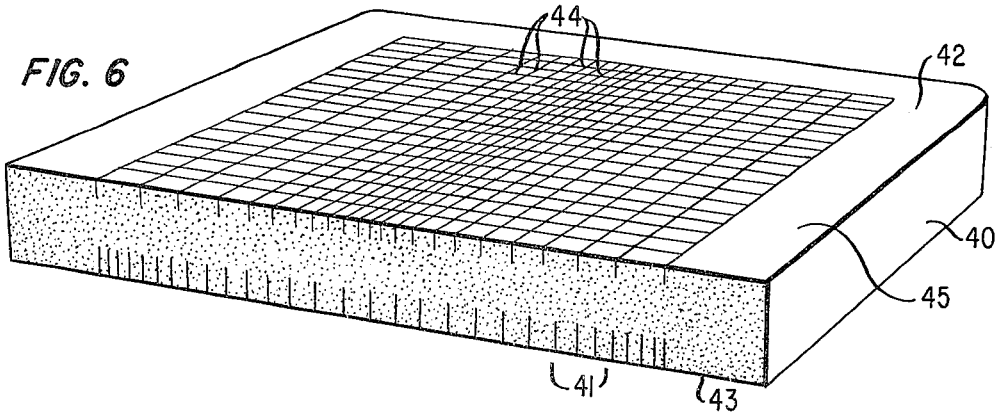
FIG. 6 is a perspective view of a section of yet another embodiment in accordance with the invention.

Description is intentionally in terms of surface resiliency, so, for example, FIGS. 5, 6, and 7 generically represent convertible structures in which opposite sides are of varying "softness" or are tailored in resiliency to meet specific design objectives. Such structures may or may not be self-contained; may operate with other similar or dissimilar sections to together result in a desired article. So, sectional sofa cushions may flip over to form a sleeping surface—may be hinged to facilitate convertibility—e.g., a double thickness seat cushion or single seat and attached back in one mode, may convert to a single thickness mattress in another mode. Hinging may be by a simple bonded fabric strip.

What is claimed is:

1. Process for fabrication of a mattress designed to support a human body in which at least one massive surface of a body having desired dimensions of the final mattress is altered, characterized in that the said body is produced from a larger body by a series of steps comprising slicing, in that the alteration takes the form of slotting the said surface with slots of varying depth or spacing, and covering the said support structure with mattress ticking.

2. Process of claim 1 in which the said slotting is produced by cutting.

3. Process for fabrication of a sofa cushion designed to support a human body in which at least one massive surface of a body having desired dimensions of the final sofa cushion is altered, characterized in that the said body is produced from a larger body by a series of steps comprising slicing, in that the alteration takes the form of slotting the said surface with slots of varying depth or spacing, and covering the said support structure.

4. Process of claim 3 in which the said slotting is produced by cutting.

* * * * *